US005702552A

United States Patent [19]

Kutchmarek et al.

[11] Patent Number: 5,702,552

[45] Date of Patent: Dec. 30, 1997

[54] METHOD FOR MAKING A PLEATED EXPANDABLE CELLULAR PRODUCT FOR WINDOW COVERINGS

[75] Inventors: Darrell J. Kutchmarek, Waunakee; James H. Stauffacher, Middleton, both of Wis.

[73] Assignee: Springs Window Fashions Division, Inc., Middleton, Wis.

[21] Appl. No.: 577,680

[22] Filed: Sep. 4, 1990

Related U.S. Application Data

[63] Continuation-in-part of Ser. No. 502,575, Mar. 30, 1990, Pat. No. 5,160,563, which is a continuation-in-part of Ser. No. 417,725, Oct. 5, 1989, abandoned.

[51] Int. Cl.[6] ..... B32B 3/12; B32B 31/12

[52] U.S. Cl. ..... 156/197; 156/204; 156/292; 160/84.05; 428/116; 428/188

[58] Field of Search ..... 428/129, 188, 428/116; 156/197, 204, 292; 160/84.1, 84.05

[56] References Cited

U.S. PATENT DOCUMENTS

| | | | |
|---|---|---|---|
| 2,101,906 | 12/1937 | Hopkinson . | |
| 2,375,451 | 5/1945 | Waters . | |
| 2,495,130 | 1/1950 | Pilliner . | |
| 2,874,611 | 2/1959 | Luboshez . | |
| 2,874,612 | 2/1959 | Luboshez . | |
| 3,443,860 | 5/1969 | Luboshez . | |
| 4,347,887 | 9/1982 | Brown | 160/84.1 X |
| 4,450,027 | 5/1984 | Colson | 156/197 X |
| 4,685,986 | 8/1987 | Anderson | 428/188 X |
| 4,950,218 | 8/1990 | Tsuru et al. | 156/197 X |
| 4,984,617 | 1/1991 | Corey | 160/84.1 |
| 5,015,317 | 5/1991 | Corey et al. | 156/204 X |

*Primary Examiner*—Michele K. Yoder
*Attorney, Agent, or Firm*—Vernon J. Pillote

[57] ABSTRACT

A method and apparatus for forming a pleated cellular shade product from a single web of material to provide different physical characteristics on opposite sides of the shade product. A web is provided having alternate first and second stripe areas extending crosswise of the web at a preset repeat spacing and the striped web is folded crosswise of the web alternately in a first direction along a first fold line intermediate side edges of the first stripe area and in a second direction along a second fold line intermediate side edges of each second stripe area to form a plurality of sidewise adjacent panels serially united in alternate succession along respective first and second fold lines. Faces of sidewise adjacent panels that are united along the first fold lines are joined in a first band spaced from the associated first fold line a distance greater than one-half the fold spacing and within the second stripe areas, and faces of sidewise adjacent panels that are united along the second fold lines are joined in a second band spaced from the associated second fold line a distance greater than one-half the fold spacing and within the first stripe areas.

12 Claims, 4 Drawing Sheets

METHOD FOR MAKING A PLEATED EXPANDABLE CELLULAR PRODUCT FOR WINDOW COVERINGS

CROSS-REFERENCE TO RELATED APPLICATION

This application is a continuation-in-part of the application of Darrell J. Kutchmarek and James H. Stauffacher, Ser. No. 07/502,575, filed Mar. 30, 1990, for "Method And Apparatus For Making An Expandable Cellular Shade", now U.S. Pat. No. 5,160,563 issued, Nov. 3, 1992; which is a continuation-in-part of the application of Kent V. Anderson, Joseph E. Cole, Darrell J. Kutchmarek, Paul A. Schneider, and James H. Stauffacher, Ser. No. 07/417,725, filed Oct. 5, 1989, for "Expandable and Collapsible Cellular Shade", now abandoned both assigned to the assignee of the present invention.

BACKGROUND OF THE INVENTION

The present invention relates to a method for making a pleated multi-cell product for window coverings and the like from a single web of material in which the web is accordion folded alternately in opposite directions along first and second creased folds disposed at opposite sides of the shade product, with sidewise adjacent panels having adjacent faces joined together along a narrow band parallel to and spaced from the creased fold therebetween a distance somewhat greater than one-half the width the panel and such that the expanded shade product defines a double row of overlapping cells. With this type of shade product, one side of the web will be exposed at one side of the shade product and the opposite side of the web will be exposed at the opposite side of the shade product. Thus, as disclosed in the aforementioned application Ser. No. 07/417,725, opposite sides of the web can be formed with different physical characteristics such as different colors or textures for different aesthetics, or with a light reflection or absorbent surface on one side or the other of the web for enhanced insulating characteristics, and the shade product formed from such a web will have different physical characteristics at opposite sides. However, it is frequently desired to have shades formed of a light transmitting material or a porous material and with such webs it may not be possible to treat or coat one side of the web without adversely affecting the characteristics or appearance of the opposite of the web.

SUMMARY OF THE INVENTION

It is an object of the present invention to provide a method for forming an expandable and collapsible shade product from a single web of material, in which the shade product can be formed with different physical characteristics at opposite sides of the shade product without the physical characteristics at one side of the shade product adversely affecting the appearance or physical characteristics of the other side of the shade product.

In accordance with the present invention, a pleated cellular shade product having different physical characteristics on opposite sides of the shade product is formed from a single web of material, by providing the web with alternate first and second stripe areas having different physical characteristics extending crosswise of the web at a preselected repeat distance; accordion folding the web crosswise of the length alternately in a first direction along a first fold line intermediate its side edges of each first stripe area and in a second direction along a second fold line intermediate the side edges of each second stripe area to form a stack of sidewise adjacent panels each having a width substantially one-half the repeat distance and serially united in alternate succession along respective first and second fold lines with each panel having a portion of a first stripe area contiguous to the associated first fold line and a portion of a second stripe area contiguous to the associated second fold line. Thereafter, faces of sidewise adjacent panels that are united along the first fold lines are joined together in a first band spaced from the associated fold line a distance greater than one-half the fold spacing and within the second stripe areas such that only portions of the second stripe areas are exposed to view of the second side of the shade product and faces of sidewise adjacent panels that are united along second fold lines are joined together in a second band spaced from the associated second fold line a distance greater than one-half the fold spacing and within the first stripe areas such that only portions of the first stripe areas are exposed to view at the first side of the shade product.

The web is preferably of a type having light transmissive characteristics and one of the stripe areas can be provided by printing or coating or impregnating the web in the first stripe areas, to provide the desired physical characteristic at one side of the shade product without adversely affecting the appearance of the other side of the shade product. Further, the coating applied in the first stripe area on one side of the web can itself be of a light transmissive nature so that the final shade product retains an overall light transmissive character.

The first and second stripe areas each have a width greater than one-third the repeat distance and preferably approximately one-half the repeat distance and the web is folded in a first direction approximately medially between the side edges of the first stripe area and in a second direction approximately medially between the side edges of the second stripe area. In order to facilitate folding of the web substantially medially between the edges of the stripe areas, stripe markers are advantageously provided on opposite side margins of the web and repeated in synchronous with at least one of the stripe areas at locations substantially medially between the side edges of the associated stripe area and the web is thereafter folded along lines substantially aligned with the stripe markers.

The web is preferably accordion folded in an accordion folding apparatus that is operative to advance a selected length of web during each pleating cycle and to fold the web along first and second fold lines. In order to compensate for variations in the repeat distance of the stripes on the web as the web enters the pleating apparatus, the pleating apparatus is arranged to advance a length of web slightly greater than the repeat distance of the stripes on an untensioned web and the tension on the web entering the pleating apparatus is adjusted to stretch the web and increase the effective repeat distance in a manner to make the repeat distance on the web as it enters the folding apparatus substantially correspond to the length of the web that is advanced by the folding apparatus during each pleating cycle. Any variations in the perpendicularity of the stripes relative to the longitudinal axis of the web as may occur during forming the stripes and/or during winding or unwinding the striped web, are compensated by passing the web over an adjustable skew compensating roller before the web enters the web folding apparatus.

DETAILED DESCRIPTION OF THE INVENTION

Figure 1:
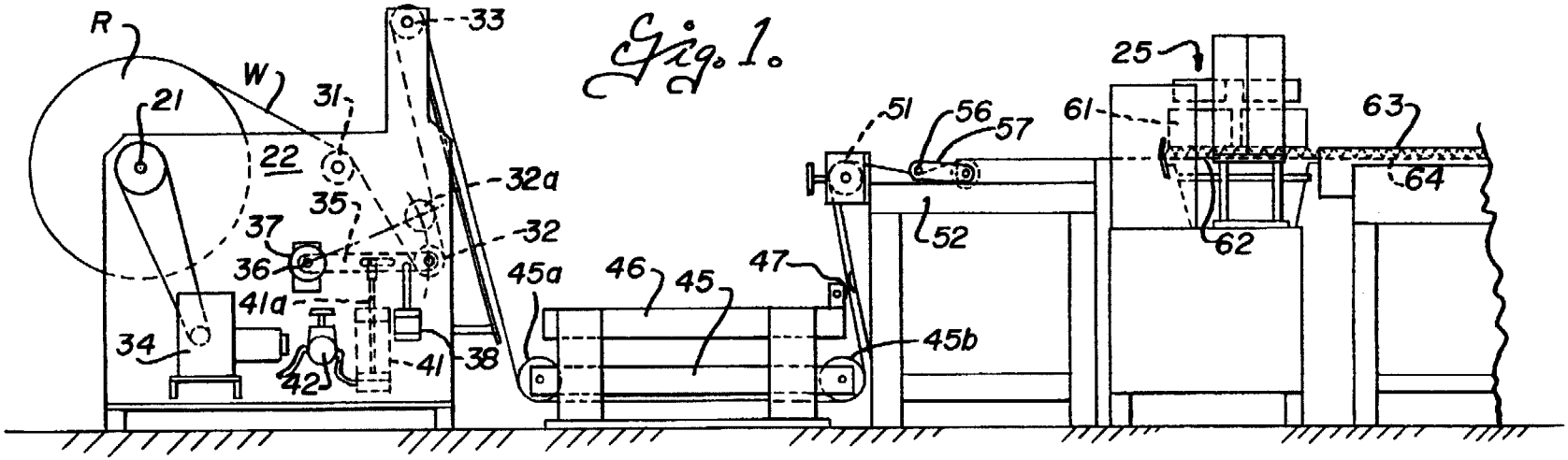
FIG. 1 is a side view of an apparatus for feeding, guiding and accordion folding a striped web.

The present invention relates to a process for the manufacture of a pleated cellular shade product from a single web of material having different physical characteristics at opposite sides of the shade product. The shade product may, for example, be formed with different colors or textures at opposite sides or with a light reflection and/or absorbent surface on one side or the other of the web for enhanced insulating characteristics. In accordance with the present invention, an elongated web W is provided with alternate first and second stripe areas S1 and S2 extending crosswise of the web at a preselected repeat distance corresponding generally to two times the desired width of the pleated cellular shade product. The physical characteristics of the first stripe areas are selected to provide the physical characteristics desired for one side of the shade and the physical characteristics of the second stripe areas are selected to provide those desired for the opposite side of the shade. The striped web can be produced by various textile weaving and printing processes and is preferably produced by selecting a web material having physical characteristics desired for one side of the shade product, and by treating, coating or printing spaced stripe areas to provide the physical characteristics desired for the other side of the shade product. For example, spaced stripe areas can be rotary screen printed on one side of a web to form the first stripe areas with the portions of the web intermediate the first stripe areas remaining unprinted to provide the second stripe areas. For reasons which will become more apparent hereafter, the first and second stripe areas each have a width greater than one-third the repeat distance and preferably about one-half the repeat distance. The web after having stripes applied thereto, can conveniently be wound into rolls for subsequent processing.

The web with stripes is accordion folded crosswise of the length of the web in an accordion folding apparatus 25 alternately in a first direction along a first fold line F1 intermediate the side edges of each first stripe area and in a second direction along a second fold line F2 intermediate the sides edges of each second stripe area to form a stack of sidewise adjacent panels each having a width substantially one-half the repeat distance and serially united in alternate succession along respective first and second fold lines with each panel having a portion of a first stripe area contiguous to the associated first fold line and a portion of a second stripe area contiguous to the associated second fold line.

Faces of sidewise adjacent panels that are united along the first fold lines are thereafter joined in a first band spaced from the associated first fold line a distance greater than one-half the fold spacing and within the second stripe areas such that only portions of the second stripe areas are exposed to view at the second side of the shade product and faces of sidewise adjacent panels that are united along second fold lines are joined together in a second band spaced from the associated second fold line a distance greater than one-half the fold spacing and within the first stripe area such that only portions of the first stripe areas are exposed to view at the first side of the shade product.

Figure 2:
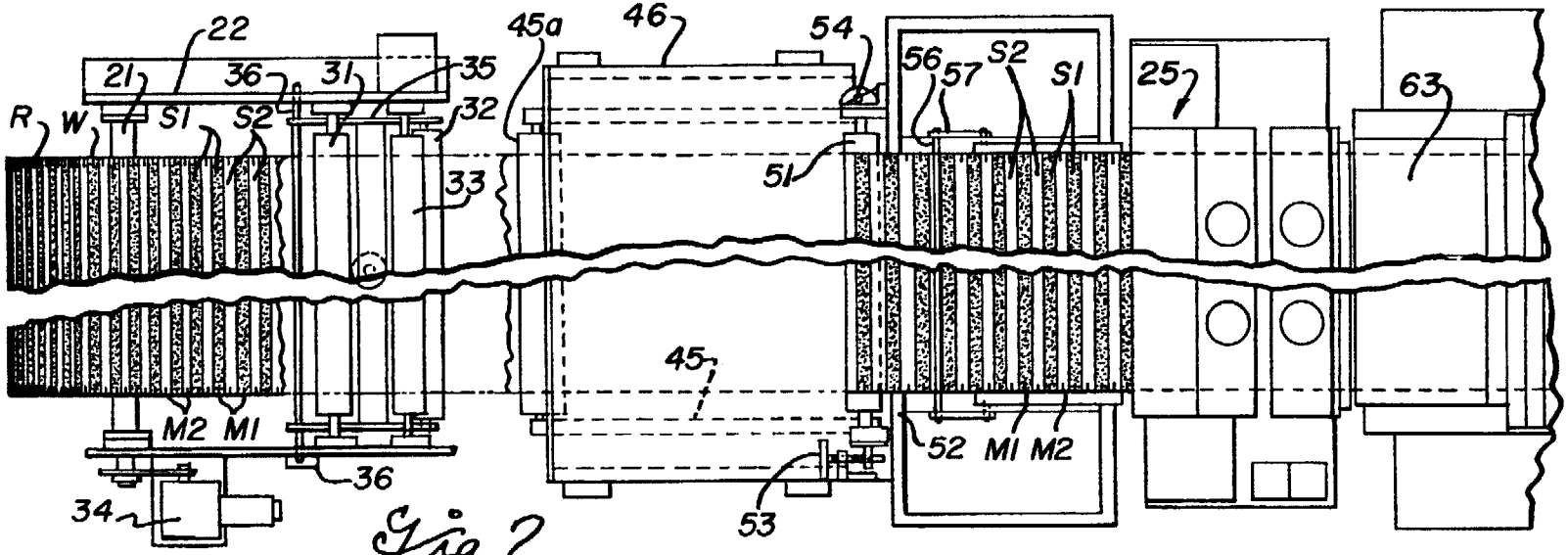
FIG. 2 is a plan view of the apparatus of FIG. 1.
Figure 3:
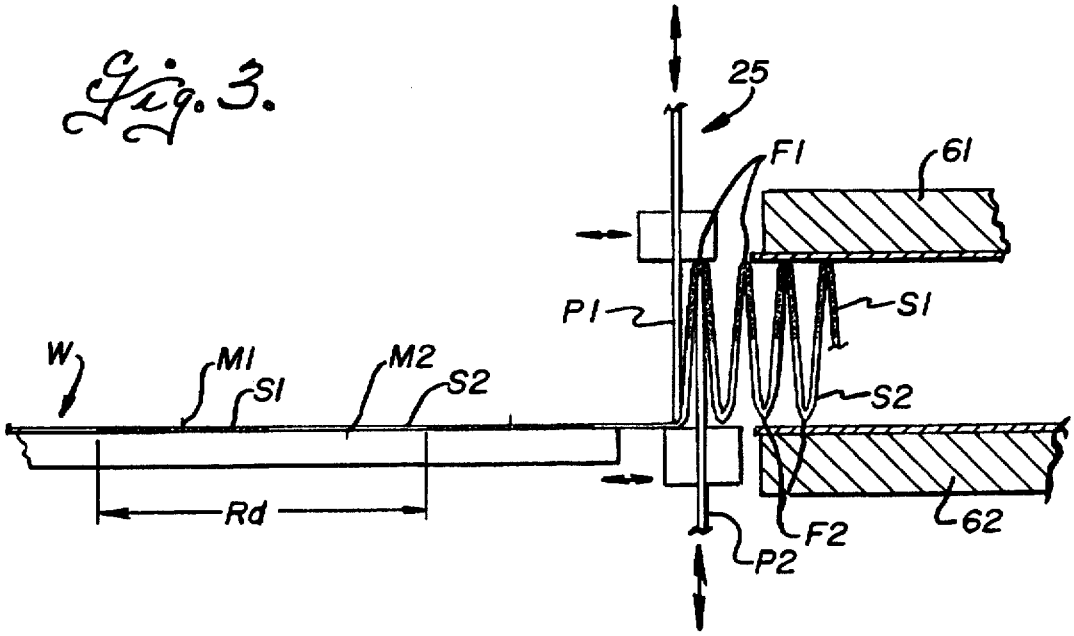
FIG. 3 is a schematic diagram of one form of apparatus for accordion folding the web.
Figure 4:
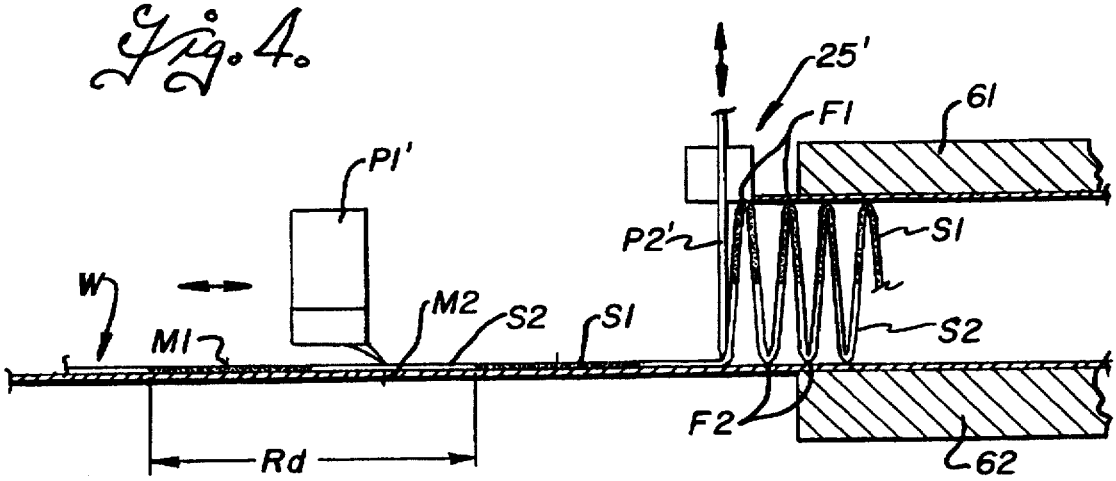
FIG. 4 is a schematic diagram of another form of apparatus for accordion folding the web.

In order to facilitate folding of the web substantiallymedially between the side edges of the first and second stripe areas, stripe markers designated M1 in FIGS. 2–4 are advantageously provided on opposite side margins of the web, repeated in synchronism with the first stripe areas at locations substantially medially between the side edges of the associated stripe areas. Further side markers designated M2 in FIGS. 2–4 can also advantageously be provided on opposite side margins of the web at locations substantially medially between the side edges of the associated second stripe areas.

Apparatus for accordion folding webs are known in the art and may be of the two blade type manufactured and sold by Karl Rabofsky GMBH of Berlin, Federal Republic of Germany, or of the blade and pusher type manufactured and sold by Enguda Industrial Company, Ltd. of Taipei, Taiwan. A two blade type accordion folding apparatus 25 is schematically illustrated in FIG. 3 and is generally of the type disclosed in U.S. Pat. No. 2,101,906. A blade and pusher type accordion folding apparatus 25' is schematically illustrated in FIG. 4 and is generally of the type disclosed in U.S. Pat. No. 2,495,130. In general, in the two blade type accordion folding apparatus, one blade P1 is disposed at one side of the web and a second blade P2 at the opposite side of the web. The blade P1 is mounted for movement in one direction crosswise of the web to fold the web in one direction along a fold line F1 and the second blade P2 is movable in the opposite direction crosswise of the web to fold the web in the opposite direction along a fold line F2. The blades P1 and P2 are also mounted for limited movement in a direction lengthwise of the web in timed relation with the movement of the blade crosswise of the web, to retract the blade at the outlet end of the folding apparatus and move it to a position at the inlet side of the other blade while the other blade is moved to the outlet end of the folding apparatus to press the folded panel onto the end of the stack of panels. In the blade and pusher type accordion folding apparatus schematically illustrated in FIG. 4, a blade designated P2' is mounted for movement in one direction crosswise of the web into engagement with a clamp surface to form a fold line F2 and, while the blade P2' is clamping the web along the fold line F2, a pleating bar P1' reciprocates along a path lengthwise the web to fold a length of web upwardly and press the folded web against the inlet side of the blade P2' and fold the web upwardly along the fold line F2 and downwardly along a fold line F1. In general, these prior art accordion folding apparatus operate during each pleating cycle to feed a preset length of web and fold the preset length of web alternately in opposite directions along first and second fold lines F1 and F2 extending crosswise of the web, to form a stack of panels disposed in sidewise abutting relation and serially united along the respective first and second fold lines.

Advance of the web to the folding apparatus is controlled to maintain the first fold lines approximately medially between the side edges of the first stripe areas and to maintain the second fold lines approximately medially between the second stripe areas. The webs used in making the shade product have at least limited stretchability and variations in the repeat distance of the stripe areas on the web can occur due to various causes including variations in printing during initial application or printing the stripes on the web; stretching or shrinkage of the web due to variations of tension during winding of the striped web into a roll and variations in humidity and/or temperature during storage and/or transportation of the web. To compensate for variations in the repeat distance of the stripes, the stripe repeat distance on the web as initially formed is made slightly less than the length of web fed by the web folding apparatus during each pleating cycle, and provision is made for maintaining tension on the web as it is advanced to the folding apparatus to stretch the web and to adjust the tension on the web to increase the repeat distance Rd of the stripes on the web as it is advanced to the folding apparatus to substantially correspond to the length of web fed by the folding apparatus during each pleating cycle.

As shown in FIGS. 1 and 2, a roll R of striped web is mounted on a shaft 21 supported for rotation in the frame of a unwind stand 22. A web tensioning roller 32 engages a loop in the web between idler rolls 31, 33, and the web tensioning roller is mounted on arms 35 attached to a shaft 36 rotatably supported on the frame of the unwind stand. The arms 35 support the tensioning roller for limited vertical movement and a means such as a potentiometer 37 is provided for sensing movement of the arms and for controlling the speed of the roll drive 34, to maintain the web tensioning roller 32 intermediate the lower position shown in FIG. 1 and an upper position indicated at 32*a*. The tension maintained on the web by the roller 32 is determined by the weight of the roller 32 and the supporting arms and any additional weights such as indicated at 38 (FIG. 1) that are attached to the arms 35, and the web tension causes limited stretching of the web to increase the repeat distance of the stripes on the initial web. The tension maintained on the web is made adjustable and while this can be achieved by adding or removing weights from the arms 35, it is more conveniently achieved by a pneumatic actuator 41 mounted on the unwind stand and having an actuator rod 41*a* operatively connected to the tension roller support arms 35. Air under a selectively adjustable pressure control regulator 42 is supplied to the pneumatic actuator to provide a selectively adjustable lift force on the arms 35 for adjusting the tension maintained on the web by the tension roller 32. The tension maintained on the web is adjusted in the manner described more fully hereinafter to stretch the wed a limited amount and increase the repeat distance of the stripes on the web and the web enters the pleating apparatus, so that the repeat distance substantially corresponds to the length of the web fed by the folding apparatus during each pleating cycle.

The web from the idler roller 33 is passed under the rollers 45*a* and 45*b* of a web guide 45 mounted on the web guide stand 46. The web guide 45 includes a web positioning sensor 47 for sensing the lateral position of at least one edge of the web and a means for shifting the web guide rollers 45*a* angularly and laterally relative to the frame 46 in a manner to laterally guide the web along a preset path of travel.

The perpendicularity of the stripe areas relative to the longitudinal axis of the web can also vary somewhat during printing or otherwise forming the stripe areas on the web, and due to variations in tension and expansion or shrinkage of the web. To compensate for variations in perpendicularity of the stripes, the web is passed from the outlet roller 45*b* of the web guide over a skew compensating roller 51 located intermediate the web guide 45 and the web folding apparatus. The skew compensating roller 51 is supported on a stand 52 at a location such that the web exiting from the roller 51 extends at a substantial angle to the web entering the roller. The skew compensating roller is mounted at 54 for limited pivotal movement relative to the frame 52 and is adjustable as by an adjusting wheel 53 to increase or decrease the distance through which one edge of the web travels relative to the other edge of the web, and thereby compensate for variations in the perpendicularity of the stripes relative to the longitudinal axis of the web. As previously described, the web folding apparatus feeds the web intermittently during a pleating cycle and a dancer roll 56 is supported by arms 57 for vertical swinging movement on the stand 52 and is arranged to engage the web at a location in advance of the folding apparatus to maintain tension on the web during cyclical variations in the rate of feed of the web by the web folding apparatus.

As previously described, the repeat distance of the stripe on the untensioned web in the roll R is made slightly less, for example of the order of 0.010 inches, than the length of web that is advanced by the folding apparatus during each pleating cycle, and the tension on the web is adjusted to stretch the web and increase the repeat distance of the stripes on the web entering the folding apparatus, to substantially correspond to the length of web fed by the folding apparatus during each pleating cycle. This can conveniently be effected by visually observing the location of the fold lines, as they are being folded in the folding apparatus or even after folding, and by adjusting the air pressure on the pneumatic actuator 41 to increase the web tension if the fold lines lead the mid-point of the associated stripe, and to decrease the web tension if the fold lines lag the midpoint of the associated stripe. Automatic means can also be provided for sensing the position of either the stripes or the stripe markers in timed relation with the operation folding apparatus, so as to automatically increase or decrease the web tension in the manner described above. The amount of stretch produced in the web as it is advanced to the pleating apparatus is very small and usually within the elastic limits of the web. Since the folded web exiting from the pleating apparatus is not under tension, the folded web will tend to contract lengthwise until the spacing between the fold lines is substantially one-half the initial stripe repeat distance in the untensioned web.

The web can be formed of various different materials having at least limited stretchability and which are foldable and adapted to retain permanently set creased folds. The web may, for example, be formed of suitable plastic films such as polyester film, or from woven and non-woven material formed of various fibers including natural fibers or synthetic fibers, such as polyester that retains a crease when folded in the presence of heat. As best shown in FIG. 1, upper and lower heating platens 61 and 62 are positioned respectively above and below the stack of folded panels advanced from the folding apparatus, to heat the upper and lower fold lines, and upper and lower cooling panels 63 and 64 are disposed respectively above and below the stack of folded panels as they are advanced from the heating platens, to cool and set the fold lines.

As best shown in FIGS. 3 and 4, the striped web, folded alternately in a first direction along the first fold lines F1 intermediate the side edges of the first stripe area and in a second direction along the second fold lines F2 intermediate the side edges of each second stripe area, forms a plurality of sidewise adjacent panels each having a width substantially one-half the repeat distance and serially united in alternate succession along respective first and second fold lines, with each panel having a portion of a first stripe area contiguous to the associated first fold line and a portion of a second stripe area contiguous to the associated second fold line. Faces of the sidewise adjacent panels that are united along the first fold lines are thereafter joined in a first band spaced from the associated fold line a distance greater than one-half the fold spacing and within the second stripe area such that only portions of the second stripe areas are exposed to view of the second side of the shade product, and faces of sidewise adjacent panels that are united along the second fold lines are joined in a second band spaced from the associated second fold line a distance greater than one-half the fold spacing and within the first stripe area such that only portions of the first stripe areas are exposed to view at the first side of the shade product.

Figure 5:
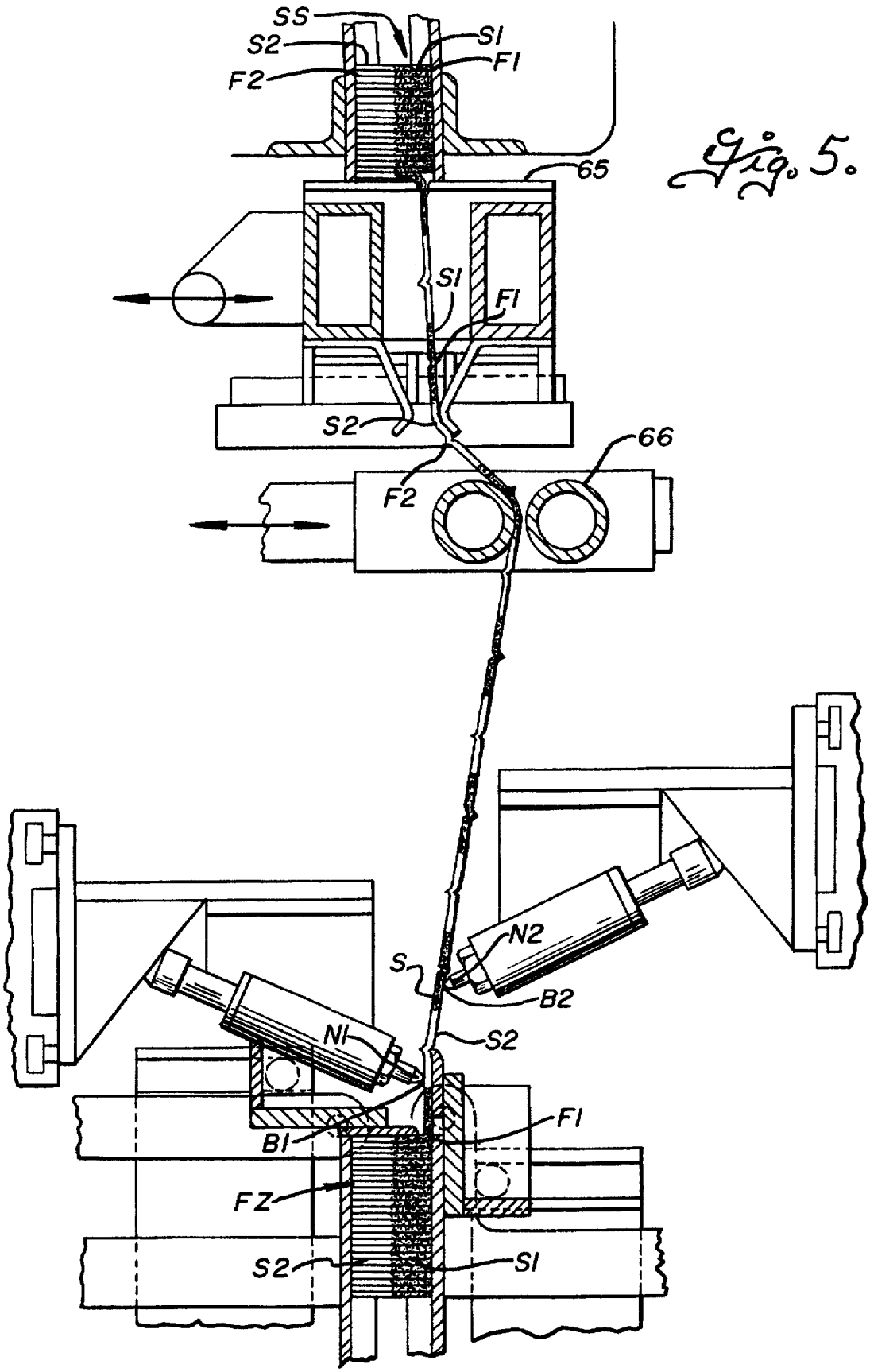
FIG. 5 is a schematic diagram of an apparatus for feeding folded panels from a stack, applying adhesive bands to the panels, and refolding and joining the panels.

An apparatus for applying adhesive to the panels at relatively opposite sides of the web, in bands parallel to and spaced from the creased folds, and for refolding the panels along the creased folds to adhesively bond adjacent faces of the panels together along a band spaced from the associated creased fold, is schematically illustrated in FIG. 5. This apparatus is advantageously of the type disclosed in the aforementioned co-pending application of D. J. Kutchmarek and James H. Stauffacher, Ser. No. 07/502,575, to which reference is hereby made for a more complete description of the construction and operation. In general, panels are fed in succession from an outlet end of a supply stack SS of folded web panels, in a downward direction and in an unfolded condition through an adhesive applying zone to the upper end of a refold stack FZ. Adhesive is applied to the panels at relatively opposite sides of the web, in bands parallel to and spaced from the creased folds, and the panels are then refolded in succession along the creased folds, to adhesively bond adjacent faces of the panels together along a band spaced from the associated creased folds. In the apparatus schematically illustrated in FIG. 5, adhesive bands B1 and B2 are applied simultaneously at relatively opposite sides of the web to two adjacent panels. As disclosed in the aforementioned application, the adhesive band can also be applied first to one panel at one side of the web and that panel then refolded onto the stack, and thereafter to the next succeeding panel at the other side of the web, and the succeeding panel thereafter refolded onto the end of the stack.

The panels are advantageously fed from the supply stack SS in succession and in timed relation with the refolding of the panels and, as shown in FIG. 5, the lower end of the supply stack is supported on shuttle blades that are reciprocated crosswise of a vertical plane medially between the side edges of the supply stack to strip off one panel at a time, and the unfolded web intermediate the shuttle at the inlet end of the refold stack is displaced laterally of the median plane in timed relation with the reciprocation of the shuttle by web tensioning rolls 66, to increase tension on the web as the shuttle is respectively moved from a first side and to a second side of the median plane, to aid withdrawal of successive panels from the supply stack.

As also shown in FIG. 5, one nozzle N1 is mounted for movement along a path spaced from the fold line F1 to apply an adhesive band B1 spaced from the fold line F1 a distance greater than one-half and preferably about two-thirds the spacing between adjacent folds and within the second stripe area S2, and the other nozzle N2 is arranged to apply adhesive in a band B2 at the other side of the web spaced from the fold line F2 a distance greater than one-half, and preferably about two-thirds, the fold spacing and within the first stripe area. Thus, when the panels are refolded in succession with the adhesive applied thereto, faces of sidewise adjacent panels that are united along the first fold lines are joined in a first band spaced from the associated first fold line and within the second stripe areas, and faces of adjacent panels that are united along the first fold lines are joined in a second band spaced from the associated second fold line and within the first stripe areas.

Figure 6:
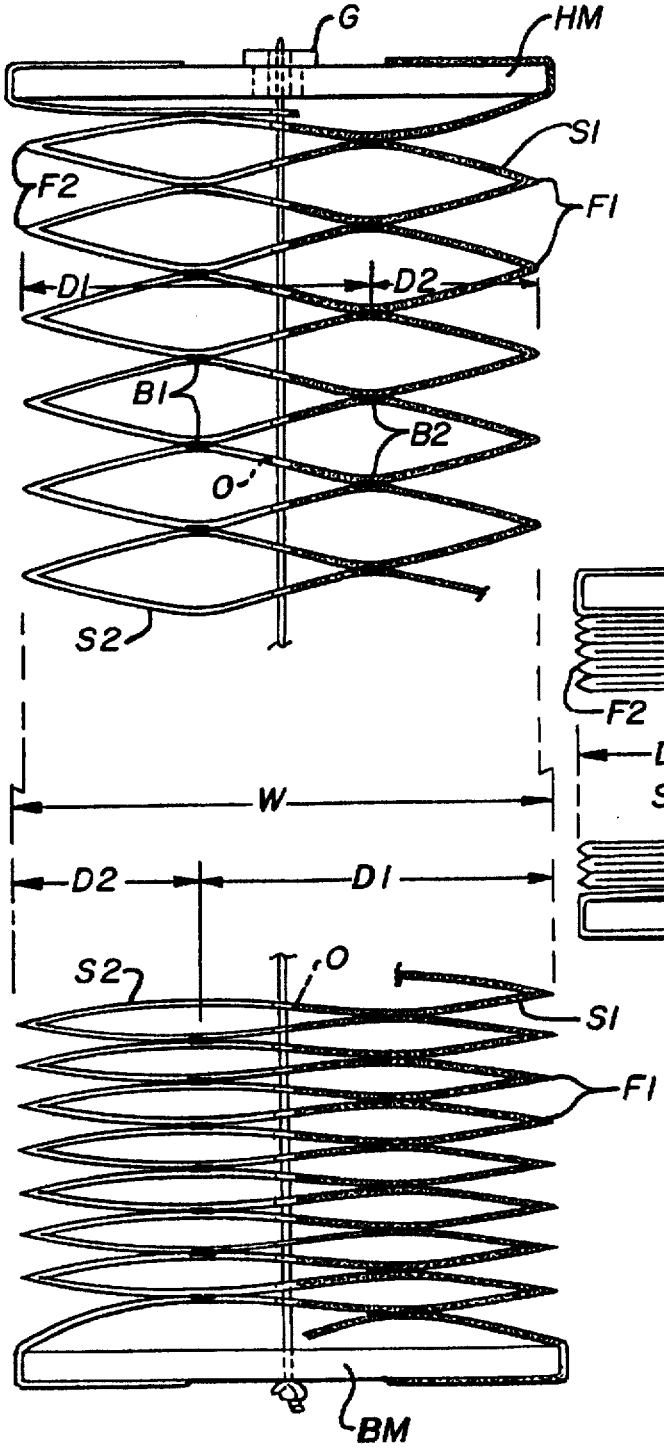
FIG. 6 is an end view of a window covering embodying a shade product made in accordance with the present invention, and illustrating the window covering in an expanded condition.
Figure 7:
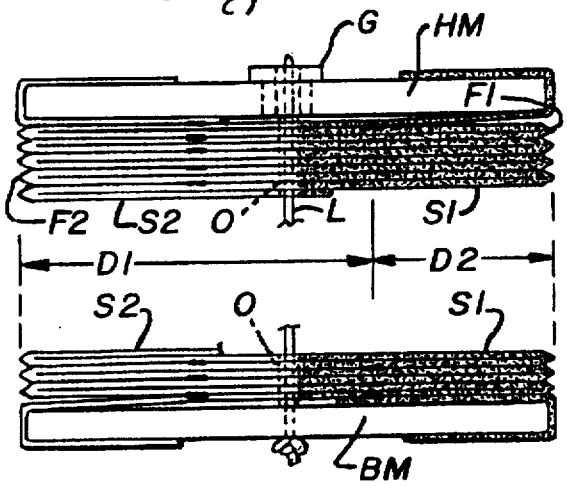
FIG. 7 is an end view of the window covering in a collapsed condition.

A shade embodying the cellular product made by the process of the present invention is illustrated in FIGS. 6 and 7. As will be seen, faces of sidewise adjacent panels that are united along the first fold lines F1 are joined together in a first band B1 spaced from the associated first fold line F1 a distance D1 greater than one-half the fold spacing and within the second stripe areas S2 so that only portions of the second stripe areas S2 are exposed to view at the second side of the shade product, and faces of sidewise adjacent panels that are united along second fold lines F2 are joined together in a second band B2 spaced from the associated second fold line F2 a distance D2 greater than one-half the fold spacing and within the first stripe areas S1 such that only portions of the first stripe areas are exposed to view at the first side of the shade product. The bands B1 and B2 are preferably located so that the centerlines of the bands B1 and B2 are spaced substantially two-thirds of the width of the panels from the associated fold lines F1 and F2 such that the distance designated D1 in FIGS. 6 and 7 is substantially two-thirds of the width of the panels and the distance designated D2 in FIGS. 6 and 7 is substantially one-third the width of the panels.

The embodiments of the invention in which an exclusive property or privilege is claimed are defined as follows:

1. A process for the manufacture of pleated cellular shade product for the use in a shade and having different physical characteristics at first and second sides of the shade product comprising:

(a) providing an elongated web having alternate first and second stripe areas extending crosswise of the web at a preselected repeat distance, the first and second stripe areas having different physical characteristics and each having a width approximately one-half of the repeat distance, (b) accordion folding the web in an accordion folding apparatus along first and second fold lines extending crosswise of the web and spaced apart a distance substantially one-half the repeat distance to form a stack of panels disposed in sidewise abutting relation and serially united along respective first and second fold lines;

(c) controlling advance of the web to the accordion folding apparatus to maintain the first fold lines approximately medially between side edges of the first stripe areas and to maintain the second fold lines approximately medially between side edges of the second stripe areas, the step of controlling advance of the web to the folding apparatus including maintaining tension on the web as it is advanced to the folding apparatus and adjusting the web tension to increase or decrease lengthwise stretching of the web;

(d) joining faces of sidewise adjacent panels that are united along the first fold lines in a first band parallel to and spaced from the associated first fold line a distance greater than one-half the fold spacing and within the second stripe areas such that only portions of the second stripe areas are exposed to view at the second side of the shade product, and joining faces of sidewise adjacent panels that are united along the second fold lines in a second band parallel to and spaced from the associated second fold line a distance greater than one-half the fold spacing and within the first stripe areas such that only portions of the first stripe areas are exposed to view at the first side of the shade product.

2. The process of claim 1 wherein the step of controlling advance of the web to the accordion folding apparatus includes passing the web over a skew compensating roller in advance of the folding apparatus, and adjusting the skew compensating roller to maintain the stripes on the web entering the folding apparatus substantially parallel to the fold lines formed in the web by the accordion folding apparatus.

3. A process for the manufacture of a pleated cellular shade product for use in a shade and having different physical characteristics at opposite sides of the shade product comprising, a) providing an elongated web having alternate first and second stripe areas extending crosswise of the web at a preselected repeat distance, the first and second stripe areas having different physical characteristics and each having a width approximately one-half the repeat distance;

b) accordion folding the web in an accordion folding apparatus, operating the folding apparatus through successive pleating cycles and in each pleating cycle feeding a length of web slightly greater than the stripe repeat distance and folding the length of web fed during each pleating cycle alternately in opposite directions along first and second lines extending crosswise of the web to form a stack of panels disposed in sidewise abutting relation and serially united along respective first and second fold lines;

c) controlling advance of the web to the accordion folding apparatus to maintain the first fold lines approximately medially between side edges of the first stripe areas and to maintain the second fold lines approximately medially between side edges of the second stripe areas, the step of controlling advance of the web including maintaining tension on the web as it is advanced to the folding apparatus sufficient to stretch the web and increase the repeat distance of the stripes on the web to substantially correspond to the length of the web fed by the folding apparatus during each pleating cycle;

d) joining faces of sidewise adjacent panels that are united along the first fold lines in a first band parallel to and spaced from the associated first fold line a distance greater than one-half the fold spacing and within the second stripe areas such that only portions of the second stripe areas are exposed to view at the second side of the shade, and joining faces of sidewise adjacent panels that are united along the second fold lines in a second band parallel to and spaced from the associated second fold line a distance greater than one-half the fold spacing and within the first stripe areas such that only portions of the first stripe areas are exposed to view at the first side of the shade.

4. A process for the manufacture of a pleated cellular shade product of use in a shade and having different physical characteristics on opposite sides of the shade product comprising: providing an elongated web having first and second sides and alternate first and second stripe areas extending crosswise of the web at a preselected repeat distance, the first and second stripe areas having different physical characteristics and each having a width greater than one-third of the repeat distance, accordion folding and creasing the web crosswise of the length of the web alternately in a first direction along a first creased fold intermediate side edges of each first stripe area and in a second direction along a second creased fold intermediate the side edges of each second stripe area to form a plurality of sidewise adjacent panels each having width substantially one-half the repeat distance and serially united in alternate succession along respective first and second creased folds with each panel having a portion of a first stripe area contiguous to the associated first creased fold and a portion of a second stripe area contiguous to the associated second creased fold, thereafter unfolding the accordion folded web and advancing successive panels in an unfolded condition lengthwise of the web through an adhesive applying zone to an inlet end of a refold stack, applying adhesive at the second side of the web to one of each pair of panels that are united along the first creased fold in a first band parallel to and spaced from the associated first creased fold a distance greater than one-half the fold spacing and within the second stripe areas and applying adhesive at the first side of the web to one of each pair of panels that are united along the second creased fold in a second band parallel to and spaced from the associated second creased fold a distance greater than one-half the fold spacing and within the first stripe areas, and refolding the panels in succession along the associated creased fold onto the upper end of the refold stack to adhesively join adjacent faces of the pairs of panels along the first and second bands whereby only portions of the first stripe areas are exposed to view at a first side of the shade product and only portions of the second stripe areas are exposed to view at a second side of the shade product, wherein the web is accordion folded in an accordion folding apparatus, operating the folding apparatus through successive pleating cycles and in each pleating cycle feeding a length of web slightly greater than the stripe repeat distance and folding the length of web fed during each pleating cycle alternately in opposite directions for form the first and second creased folds, controlling advance of the web to the accordion folding apparatus to maintain the first creased folds approximately medially between side edges of the first stripe areas and to maintain the second creased folds approximately medially between side edges of the second stripe areas, the step of controlling advance of the web including adjustably maintaining tension on the web as it is advanced to the folding apparatus sufficient to stretch the web and increase the repeat distance of the stripes on the web to substantially correspond to the length of the web fed by the folding apparatus during each pleating cycle.

5. The process of claim 4 wherein the step of controlling advance of the web to the accordion folding apparatus includes passing the web over a skew compensating roller in advance of the folding apparatus, and adjusting the skew compensating roller to maintain the stripes on the web entering the folding apparatus substantially parallel to the fold lines formed in the web by the accordion folding apparatus.

6. The process of claim 4 wherein each stripe area has a width approximately one-half the repeat distance.

7. The process of claim 4 including forming the first creased fold approximately medially between the side edges of the associated first stripe area and forming the second creased fold approximately medially between the side edges of the associated second stripe area.

8. The process of claim 4 wherein the step of providing a web having alternate first and second stripe areas includes printing the first stripe areas on one side of the web.

9. The process of claim 4 wherein the step of providing a web having alternate first and second stripe areas includes printing the first stripe areas on one side of a web having light transmissive characteristics.

10. The process of claim 4 wherein the step of providing a web having alternate first and second stripe areas includes applying a light transmissive coating at the first stripe areas on one side of a web having light transmissive characteristics.

11. The process of claim 4 wherein the first bands have a centerline spaced from the associated first fold line a distance substantially two-thirds of the width of the panels, and the second bands have a centerline spaced from the associated second fold line a distance substantially two-thirds of the width of the panels.

12. The process of claim 4 including providing stripe markers on opposite side margins of the web repeated in registry with at least one of the stripe areas at locations substantially medially between side edges of said one of the stripe areas, controlling accordion folding of the web to maintain the creased folds in said one of the striped areas substantially aligned with the stripe markers on opposite side margins of the web.

* * * * *

UNITED STATES PATENT AND TRADEMARK OFFICE

CERTIFICATE OF CORRECTION

PATENT NO. : 5,702,552

DATED : December 30, 1997

INVENTOR(S) : Kuchmarek et al

It is certified that error appears in the above-identified patent and that said Letters Patent is hereby corrected as shown below:

In claim 4, Column 10, line 34 "for" should read -to-

Signed and Sealed this

Tenth Day of March, 1998

*Attest:*

*Attesting Officer*

BRUCE LEHMAN

*Commissioner of Patents and Trademarks*